US008172117B2

(12) United States Patent
Maggi

(10) Patent No.: US 8,172,117 B2
(45) Date of Patent: May 8, 2012

(54) STABLE BACKPACK

(75) Inventor: Gregory Maggi, Ashland, NH (US)

(73) Assignee: C&P Hiam Associates LLC, Cambridge, MA (US)

( * ) Notice: Subject to any disclaimer, the term of this patent is extended or adjusted under 35 U.S.C. 154(b) by 0 days.

(21) Appl. No.: 13/254,351

(22) PCT Filed: Nov. 2, 2010

(86) PCT No.: PCT/US2010/055088
§ 371 (c)(1), (2), (4) Date: Sep. 1, 2011

(87) PCT Pub. No.: WO2011/053961
PCT Pub. Date: May 5, 2011

(65) Prior Publication Data

US 2012/0000948 A1 Jan. 5, 2012

Related U.S. Application Data

(60) Provisional application No. 61/257,130, filed on Nov. 2, 2009.

(51) Int. Cl.
*A45F 3/08* (2006.01)

(52) U.S. Cl. ..... 224/634; 224/631; 224/641; 224/263; 224/604; 224/637

(58) Field of Classification Search ..... 224/197, 224/203, 604, 631, 633–637, 641
See application file for complete search history.

(56) References Cited

U.S. PATENT DOCUMENTS

| | | | | |
|---|---|---|---|---|
| 1,635,928 | A | | 7/1927 | Davis |
| 2,197,427 | A | | 4/1940 | Despain |
| 3,090,621 | A | | 5/1963 | Heimers et al. |
| 3,797,718 | A | * | 3/1974 | Plant ..... 224/262 |
| 3,957,184 | A | | 5/1976 | Shurman |
| 4,015,759 | A | * | 4/1977 | Dreissigacker et al. ..... 224/262 |
| 4,194,656 | A | | 3/1980 | Zufich |
| 4,214,685 | A | | 7/1980 | Pletz |

(Continued)

FOREIGN PATENT DOCUMENTS

CH 107499 3/1925

(Continued)

OTHER PUBLICATIONS

PCT Notification of Transmittal of the International Search Report and the Written Opinion of the International Searching Authority, or the Declaration, Jul. 18, 2011, for Application PCT/US2010/055088.

(Continued)

*Primary Examiner* — Justin Larson
*Assistant Examiner* — John Cogill
(74) *Attorney, Agent, or Firm* — Mark Nowotarski

(57) ABSTRACT

A stabilized backpack comprises a hip suspension and a shoulder suspension. The hip suspension comprises vertical support rods pivotally attached to the hip belt and pack frame to allow motion of the wearer's hips without causing varying forces on the pack. The shoulder suspension comprises pulleys and cords attaching the shoulder straps to the pack so that the motion of the wearer's shoulders does not cause varying forces on the pack. The net effect is that a person can run with the pack, with heavy load, in rough terrain, with the pack staying relatively stable.

11 Claims, 9 Drawing Sheets

U.S. PATENT DOCUMENTS

| | | | | |
|---|---|---|---|---|
| 4,303,186 | A * | 12/1981 | Ollinger, IV | 224/634 |
| 4,483,070 | A | 11/1984 | Junkermann | |
| 4,676,418 | A | 6/1987 | Lowe | |
| 5,090,604 | A | 2/1992 | Howe | |
| 5,114,059 | A | 5/1992 | Thatcher | |
| 5,184,763 | A * | 2/1993 | Blaisdell et al. | 224/153 |
| 5,184,764 | A | 2/1993 | Orovan et al. | |
| 5,449,102 | A | 9/1995 | Sason | |
| 5,497,922 | A | 3/1996 | Tate | |
| 5,617,984 | A | 4/1997 | Fabel | |
| 5,618,249 | A | 4/1997 | Marshall | |
| 5,730,347 | A | 3/1998 | Finot | |
| 5,806,740 | A | 9/1998 | Carlson | |
| 6,024,265 | A | 2/2000 | Clements | |
| 6,070,776 | A | 6/2000 | Furnary et al. | |
| 6,199,732 | B1 | 3/2001 | Swetish | |
| 6,276,584 | B1 | 8/2001 | McLachlan | |
| 6,290,111 | B1 | 9/2001 | Hedenberg et al. | |
| 6,375,053 | B1 | 4/2002 | Cecchinel | |
| 6,607,108 | B2 | 8/2003 | Mydans | |
| 6,802,442 | B1 | 10/2004 | Thompson | |
| 6,982,497 | B2 | 1/2006 | Rome | |
| 7,100,809 | B2 | 9/2006 | Arnold et al. | |
| 7,287,677 | B2 | 10/2007 | Reid | |
| 7,431,184 | B2 | 10/2008 | Gregory | |
| 7,931,178 | B2 | 4/2011 | Rome | |
| 7,946,460 | B2 * | 5/2011 | Yip | 224/631 |
| 7,967,175 | B2 * | 6/2011 | Bass et al. | 224/634 |
| 7,997,466 | B2 * | 8/2011 | Fidrych et al. | 224/634 |
| 8,020,738 | B2 | 9/2011 | Storey | |
| 2002/0162871 | A1 | 11/2002 | Vigny | |
| 2002/0170932 | A1 | 11/2002 | Higgins et al. | |
| 2004/0262343 | A1 | 12/2004 | Pratt et al. | |
| 2005/0092802 | A1 | 5/2005 | Maley | |
| 2006/0131355 | A1 | 6/2006 | Tate | |
| 2006/0191969 | A1 * | 8/2006 | Goulding et al. | 224/635 |
| 2008/0179364 | A1 | 7/2008 | Thatcher | |
| 2008/0197163 | A1 | 8/2008 | Yip | |
| 2008/0203129 | A1 | 8/2008 | Frei | |
| 2009/0127301 | A1 | 5/2009 | Fidrych et al. | |
| 2010/0243693 | A1 | 9/2010 | Terry et al. | |
| 2010/0243694 | A1 | 9/2010 | Oddou et al. | |
| 2010/0270348 | A1 | 10/2010 | Demskey | |
| 2011/0036883 | A1 | 2/2011 | Cox | |

FOREIGN PATENT DOCUMENTS

| | | | |
|---|---|---|---|
| CH | 198024 | | 8/1938 |
| CN | 2659216 | Y | 1/2004 |
| DE | 29704491 | U1 | 7/1997 |
| DE | 10033738 | A1 * | 1/2002 |
| DE | 10228388 | A1 * | 1/2004 |
| FR | 2819700 | | 7/2001 |
| GB | 907687 | | 10/1962 |
| GB | 1566704 | | 5/1980 |
| NZ | 506106 | | 5/2002 |
| NZ | 523148 | | 4/2003 |
| WO | WO 2010079354 | A1 | 7/2010 |
| WO | WO 2011044357 | | 4/2011 |

OTHER PUBLICATIONS

David L. Skaggs, et al., "Back Pain and Backpacks in School Children", *J. Pediatr. Orthop.*, vol. 26, No. 3, May/Jun. 2006, pp. 358-363.

* cited by examiner

STABLE BACKPACK

CROSS REFERENCE TO RELATED APPLICATIONS

This application claims the benefit of U.S. provisional patent application Ser. No. 61/257,130, entitled "Stable Backpack", filed Nov. 2, 2009. Said provisional patent application is incorporated herein by reference.

TECHNICAL FIELD

The inventions described herein are in the field of backpacks.

BACKGROUND ART

A backpack is a means for a person to carry a load.

FIG. 1 illustrates a backpack referred to in U.S. Pat. No. 4,676,418, entitled "Backpack Having Improved Load Distribution and Stabilizing Structures", by Greg E. Lowe (Lowe). A person has a backpack 100 mounted on his back. The backpack comprises a flexible sack 102 and a sheet frame 104. A shoulder harness 106 and a hip harness 108 are provided to mount the pack on the person. Lowe referred to means whereby the hip harness allows vertical movement 114 of the hips while the person walks 120. The shoulder harness, however, is designed to keep the pack at a fixed position and orientation relative to the person's shoulders. Lift straps 112 are provided to help the person adjust the relative weight distribution between the shoulder harness and the hip harness.

FIGS. 2A and 2B illustrates a backpack suspension referred to in U.S. Pat. No. 5,184,764, entitled "Load Support" by Orovan et al. (Orovan). A hip harness 202 is affixed to a pack frame (not shown) by a mounting plate 204. A shoulder harness 206 is affixed to the hip harness by a slideable webbing means 208. This allows the person wearing the pack to raise and lower his or her arms. When the right arm 200 is up, the right shoulder pad goes up. When the left arm 210 goes up, the webbing 212 slides through a buckle and the left shoulder pad goes up.

The features in the aforementioned back packs are described as suitable for walking or other relatively slow motions carried out by a person wearing a backpack. Hence they are suitable for gaits that merely require freedom of movement. They do not, however, take into account the requirements of a person engaged in relatively rapid gait, such as running. The requirements of running differ from walking due the fact that inertia and elastic energy recovery in the oscillating and twisting motions of the runner are important. A person is bouncing up and down and twisting from side to side as he or she runs. Running efficiently with a pack with substantial weight in it, therefore, requires that the pack be able to respond to the up and down and twisting body movements of the runner without causing undue discomfort or energy loss. Furthermore, the pack must be able to adapt to the changing stance and movements that a person goes through as he or she transitions from walking to running and vice versa.

DISCLOSURE OF INVENTION

The Disclosure of the Invention is provided as a guide to understanding the invention. It does not necessarily describe the most generic embodiment of the invention or all species of the invention disclosed herein.

FIGS. 3A and 3B illustrate the different harness requirements of a walking person 300 and a running person 330. Each person is carrying a backpack 302 with a significant weight load 314. The backpack shown is an embodiment of the invention(s) described herein. The person carrying the pack may be referred to herein as a "wearer" or "runner".

Each person is shown wearing the pack with about 13.6 kg of load. A significant weight load would be a weight load of 2 kg or more. The person is a male with a height of 180 cm and a weight of 82 kg. The drawings are based on photographs of an actual reduction to practice.

As used herein, open headed arrows indicate motion or direction. Closed head arrows point to particular items.

The person 300 in FIG. 3A is walking at a speed of about 3.2 km/h. The shoulder harness is adapted to allow free motion of the arms 324. This adaptation comprises cables and pulleys which allow the lower portions of the shoulder straps 326 to lengthen and shorten as the person walks. Cable and pulley means 328 are also provided to bring the pack close 312 to the person's torso so that the center of mass of the load 314 is as close to being over the hip joints 316 as possible. Keeping the center of mass of the load close to the hips minimizes the torque that would otherwise pull the person's torso backwards.

As used herein, "center of mass" of a load generally refers to where the center of mass would be if the pack were loaded with a uniform density load.

Vertical support bars mounted on pivots 329 are also provided to allow alternating vertical hip motion without causing undue twisting of the pack.

Thus a person walking with the pack will have relative freedom of motion of shoulders, arms and hips.

FIG. 3B illustrates the same person 330 with the same pack running at a speed of about 9.6 km/h. Relative to walking, the person is bent forward 332 at the waist. His arms and shoulders are swinging back and forth both rapidly and with large amplitude 334. His entire body is moving up and down 336 as the person alternately leaps from his right foot to his left foot and back again.

The shoulder harness now acts as an active suspension by providing constant and balanced horizontal forces 342, 344 at the shoulders. This allows the shoulders to move in twisting motions without causing undue twisting motions in the pack. The hip harness also now acts as an active suspension by providing balanced vertical forces 346 on the person's hips as said hips go through their respective twisting motions. The shoulder harness and hip harness act in concert to keep the pack close to the person's body despite the increased lean forward.

One can think of the pack as "riding" the person, with similar requirements to a jockey riding a horse. When a horse is walking, the jockey needs to primarily stay balanced on the horse and allow the horse freedom of movement. When a horse runs, however, the jockey must use his or her arms and legs as a suspension so that the jockey movements are minimized as the horse twists and leaps beneath him/her.

MODES FOR CARRYING OUT INVENTION

The following detailed description discloses various embodiments and features of the invention. These embodiments and features are meant to be exemplary and not limiting.

As used herein, the term "about" means within +/−20% of a given value unless specifically indicated otherwise.

Shoulder Harness

Figure 1:
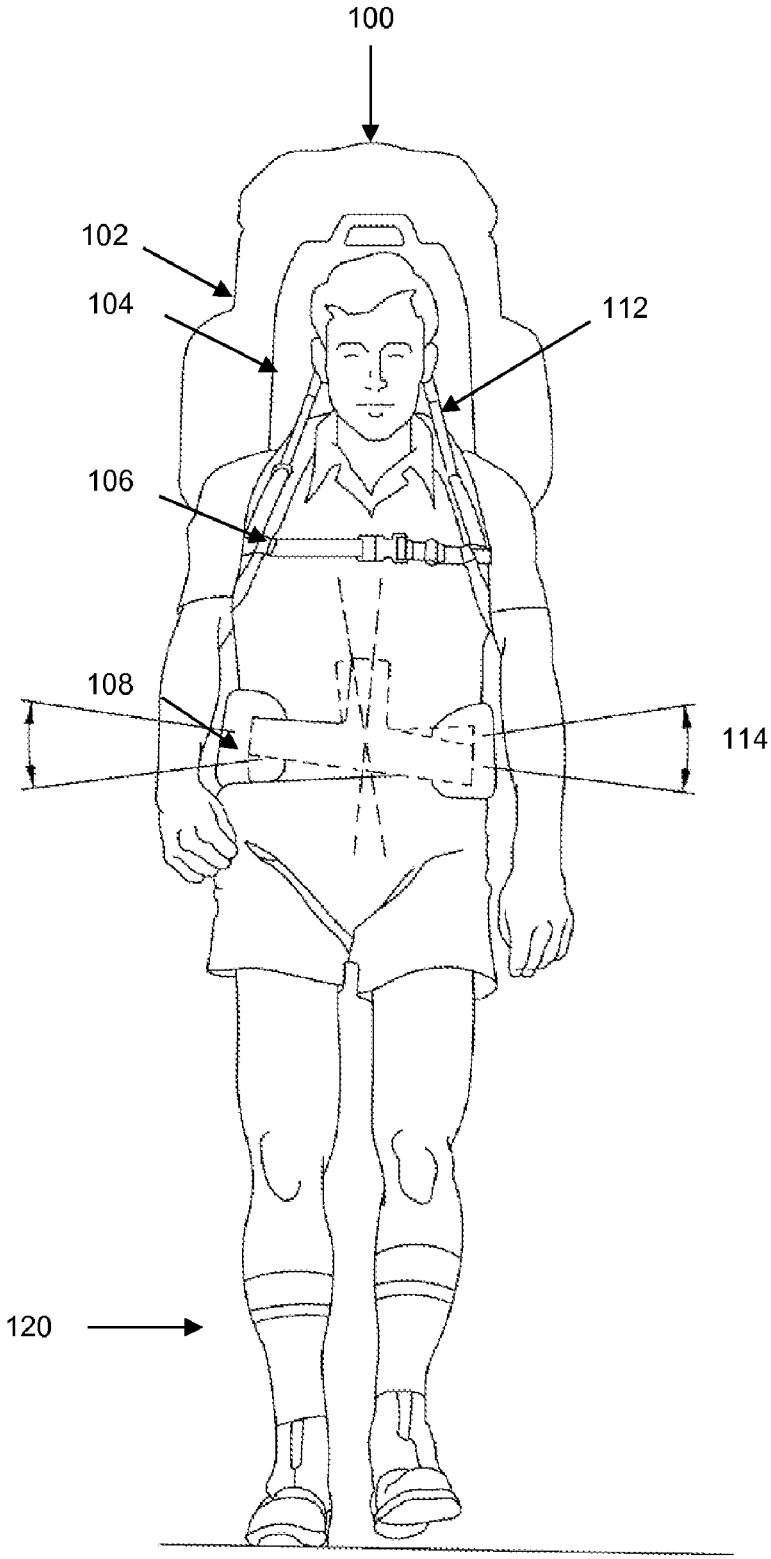
Fig. 1 (Prior art)
FIG. 1 is a backpack referred to in U.S. Pat. No. 4,676,418
Figures 2A, 2B:
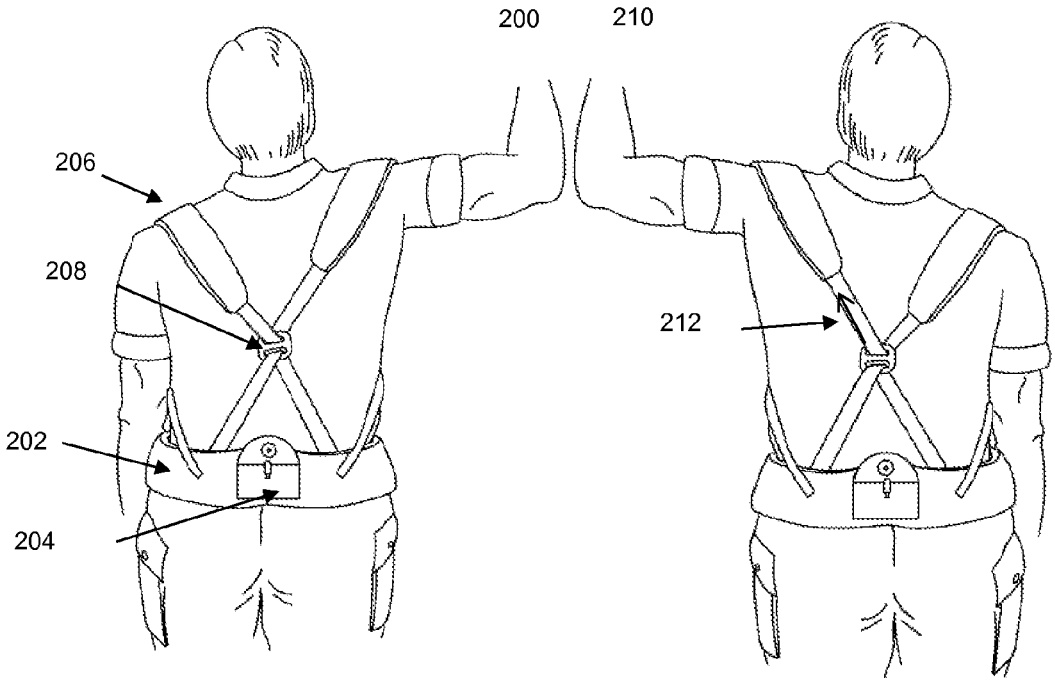
Fig. 2A (Prior art)
Fig. 2B (Prior art)
FIGS. 2A and 2B are of a backpack referred to in U.S. Pat. No. 5,184,764
Figure 3A:
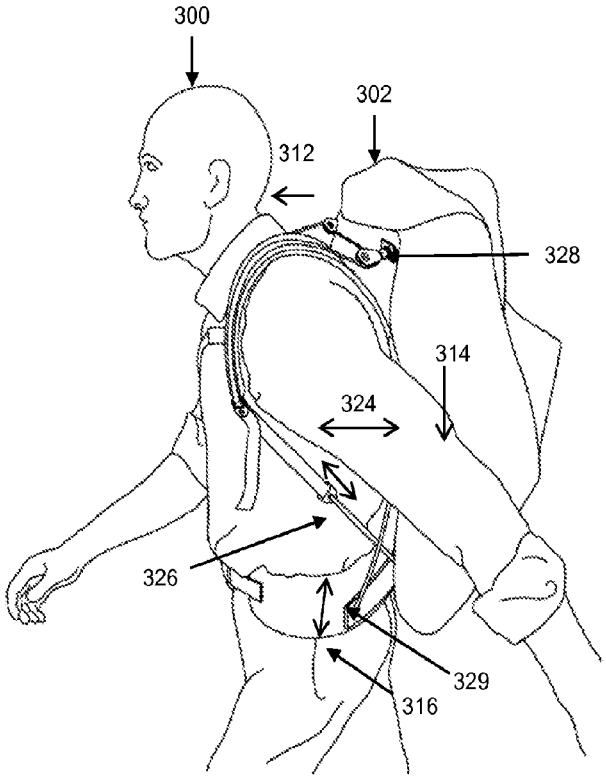
FIGS. 3A and 3B compare the requirements of a pack on a walking versus a running person.
Figure 3B:
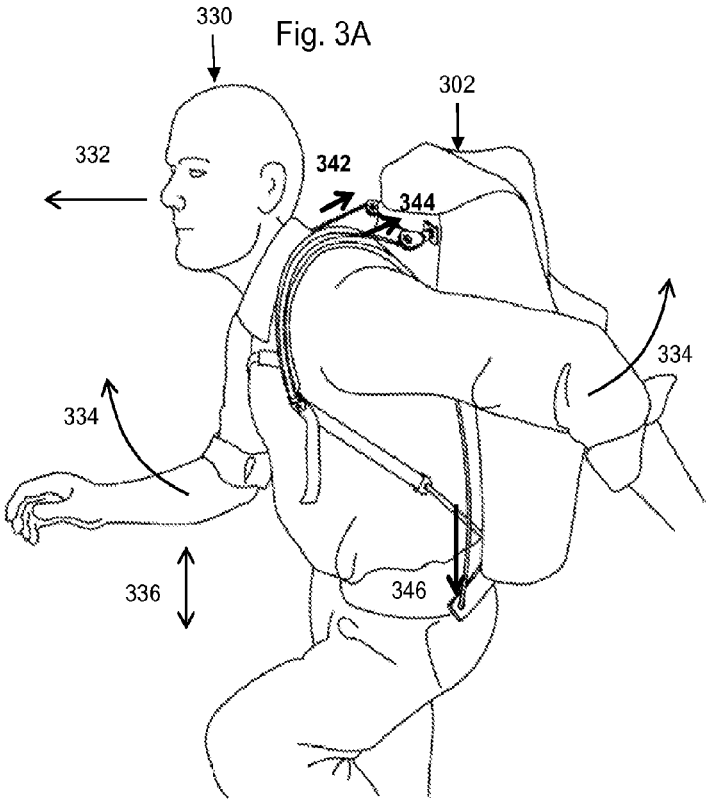
Figure 4:
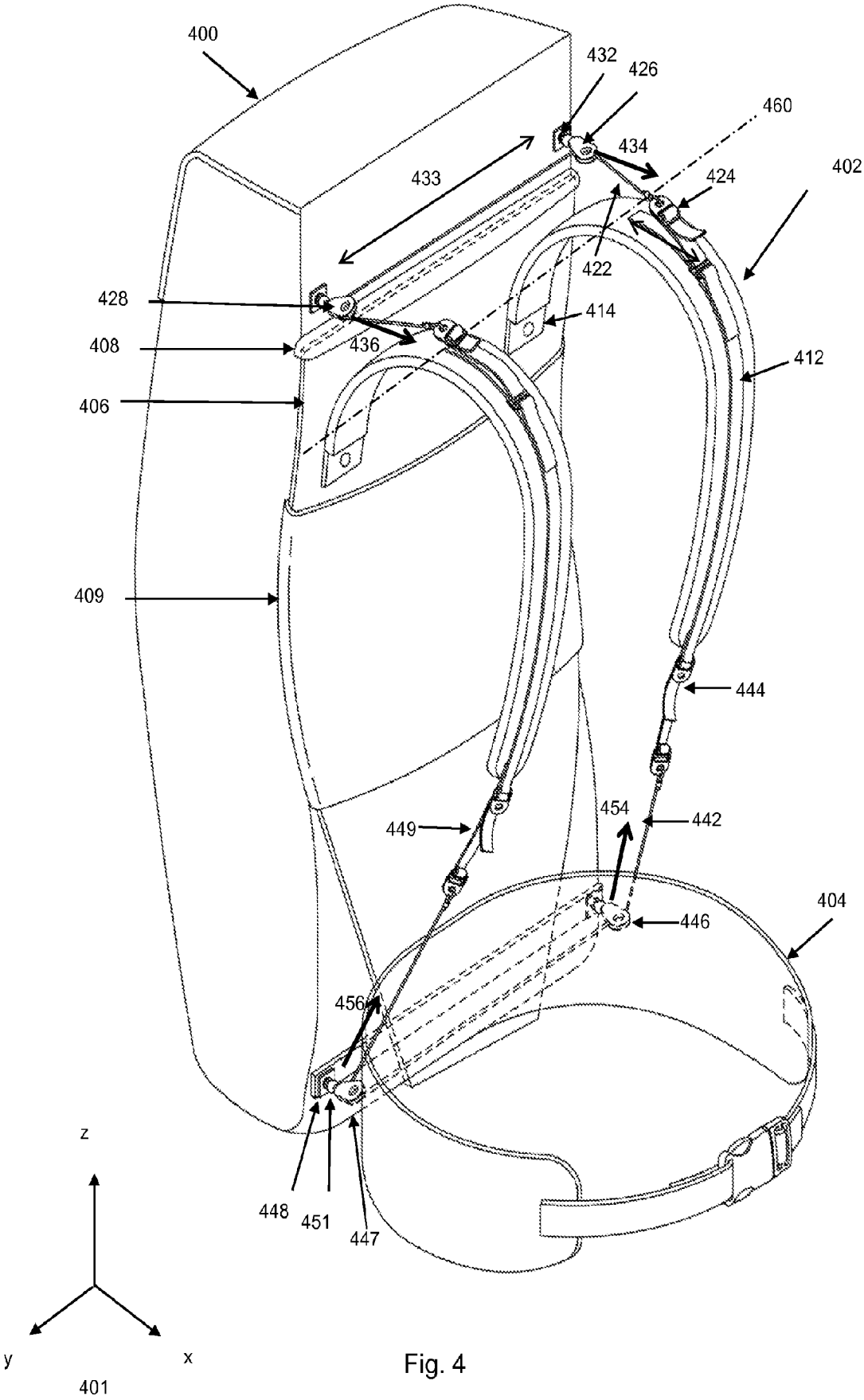
FIG. 4 illustrates an embodiment of a shoulder harness.

FIG. 4 illustrates an embodiment of a shoulder harness that is suitable for both walking and running. Three dimensional axes 401 are shown to help facilitate discussion of movement of the pack as a person runs. The axes include x, y and z axes.

A fabric container 400 is mounted on a sheet frame 406 using sleeve 409 and cap 408. Padding may be provided on the sleeve for wearer comfort. A shoulder harness is generally shown as item 402. A hip harness 404 is generically shown as item 404. The details of the hip harness will be presented in FIG. 5. Other types of containers, such as rigid containers, are also suitable. Other sorts of frames, such as tubing or bar-based frames, are also suitable. Frame materials can be metal, plastic, carbon fiber composite or other stiff, strong and lightweight material.

The shoulder harness comprises padded shoulder straps 412. Said shoulder straps are fixed to the sheet frame by pivot means 414. They may also be fixedly attached. The lower portion of a shoulder pad is attached to a piece of adjustable length webbing 444. Said webbing is attached to a lower hip cord 442. 3 mm diameter nylon cord is suitable. The lower hip cord passes through a lower hip cord pulley 446. It then proceeds behind the sheet frame to a corresponding lower hip cord pulley 447 on the other side of the pack. The lower hip cord then proceeds to a corresponding adjustable length webbing 449 attached to the other shoulder strap. Thus the lower hip cord is free to move as the shoulder pads alternately move up and down.

The lower hip cord pulleys are attached to the opposite ends of a lower hip cord pulley spacer bar 448 each with a short piece of flexible webbing 451. The ends of said lower hip cord pulley spacer bar are attached to the fabric of the container. Thus the pulleys are free to change their orientation in response to movements of the straps and chords, but are maintained at fixed locations at the bottom corners of the container. Thus, as the shoulder straps alternatively move up and down in response to a runner's arm motions, the chords provide relatively fixed and balanced vertical forces 454, 456 on each side of the bottom of the pack. These forces have relatively constant components in the z and x directions and minimal components in the y directions. This helps the pack maintain a relatively stable rotational orientation with respect to the x, y and z-axis as the runner moves beneath it. This increases comfort and reduces energy loss in the runner.

Suitable pulleys are ball bearing pulleys with very low stiction (i.e. start up friction) so that the cord will move freely therein with minimal hysteresis even with a heavy pack load and small amounts of motion. 1.27 cm diameter pulleys used in the construction of sail wings are suitable. AustriAlpin pulleys are suitable.

The lower hip cord pulley spacer bar 448 should be stiff and light. A 3.2 cm wide by 1.6 mm thick aluminum bar 30.5 cm long is suitable. The bar should be oriented so that the lower hip cord passes between it and the sheet frame and moved freely.

The tops of the shoulder straps are attached to adjustable length webbing 424. The webbing, in turn, is connected to upper shoulder cord 422. The upper shoulder cord passes through upper shoulder cord pulleys 426, 428. The upper shoulder cord pulleys may be attached directly to the fabric of the container each using a short length of flexible webbing 432. Since attachment points of the pulleys are close to the top of the sheet frame, the sheet frame keeps the pulleys apart 433.

The upper shoulder cord pulleys should be positioned at about the maximum height of the shoulder straps 460 when the shoulder pads are in a bowed configuration such as they might take when a person is wearing the pack. This corresponds to the about shoulder height of the wearer. Thus, constant and balanced horizontal forces 434 and 436 are provided to the top of the pack as the tops of the shoulder pads move due to the twisting motions of the runner. The constant and balanced horizontal forces keep the top of the pack close to the runner without causing undue z-axis twisting.

Hip Harness

Figure 5:
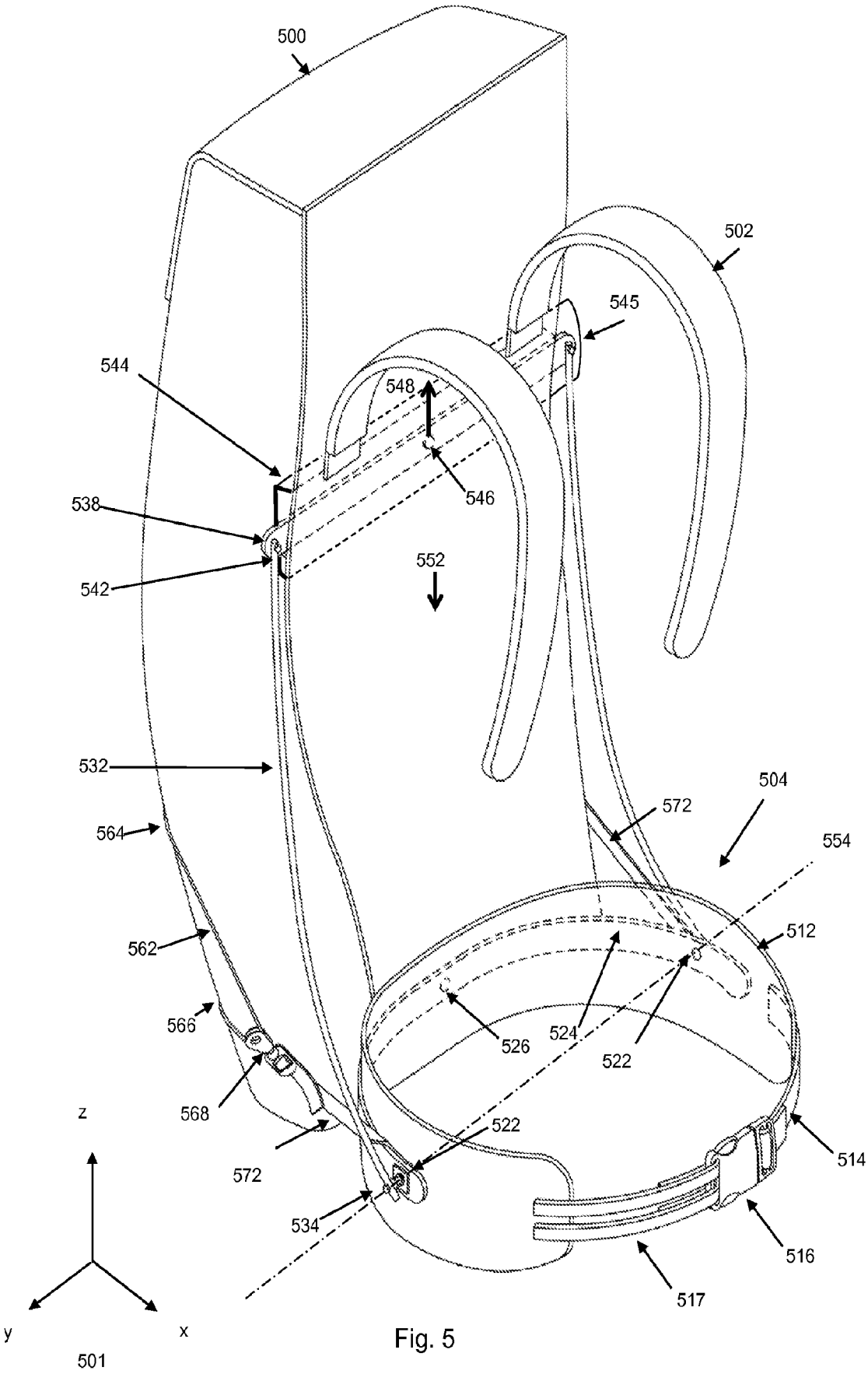
FIG. 5 illustrates an embodiment of a hip harness.

FIG. 5 illustrates an embodiment of a hip harness. Reference x, y and z axes 501 are also shown. The fabric container is item 500. The shoulder harness of FIG. 4 is shown generically as item 502. The hip harness is generally indicated by item 504.

The hip harness comprises a padded hip belt 512 attached to adjustable length fabric webbing 514. Said webbing is joined together with a buckle 516. Other closure means may be used. Split strap webbing 517 may alternatively be provided. Split strap webbing can have a more comfortable and secure fit than single strap webbing since each strap is individually adjustable in length.

The padded hip belt is attached to a curved spring hip bar 524 via pivot attachments 522. The pivot attachments may comprise ball bearings to minimize stiction. The attachments are located at about the major axis 554 of the oval formed by the hip belt when the hip belt is buckled. These points correspond to the hip joints of a wearer.

The spring hip bar is pivotally attached to the sheet frame at about the center line 526 of said frame. Ball bearings may be used in the pivot joint. Thus the hip belt is free to pivot about the x axis and y axis. Thus the pack can stay close to a wearer's back as said wearer transitions from an upright walking pose to a forward bent running pose.

The spring hip bar should be flexible enough to be deformed about the z axis so that a wearer can pull the hip belt closed when putting on the pack. It should be stiff enough to hold its shape in the xy plane, however, as the wearer moves with a loaded pack. A bar of suitable stiffness is 3.2 cm wide by 4.7 mm thick polypropylene. A suitable length of the spring hip bar is 55.8 cm. The spring hip bar's relaxed shape should be an open curve wider than a person's hips so that it will open up when the buckle is opened and thus the hip belt can be put on and removed easily.

The spring hip bar will help the pack maintain a relatively constant height as a wearer bounces up and down beneath it due to the bar's flexing in response to said bouncing.

The hip harness additionally comprises vertical support rods 532. The support rods can have a strength and flexibility comparable to that of ski poles. The materials of construction may be lightweight materials such as aluminum, fiber glass or graphite composite. The configuration can be straight tubing or tapered tubing with round, triangular or other cross section.

The support rods are attached to the hip spring bar at pivot points 522 located at about said major axis of the hip belt when the hip belt is closed. A suitable pivot attachment means 534 is a ball-and-socket joint, such as a Heim joint. The ball-and-socket joint allows the support bars to rotate outwardly when the hip belt buckle 516 is unsnapped and the spring hip bar expands to its relaxed form.

Figure 6A:
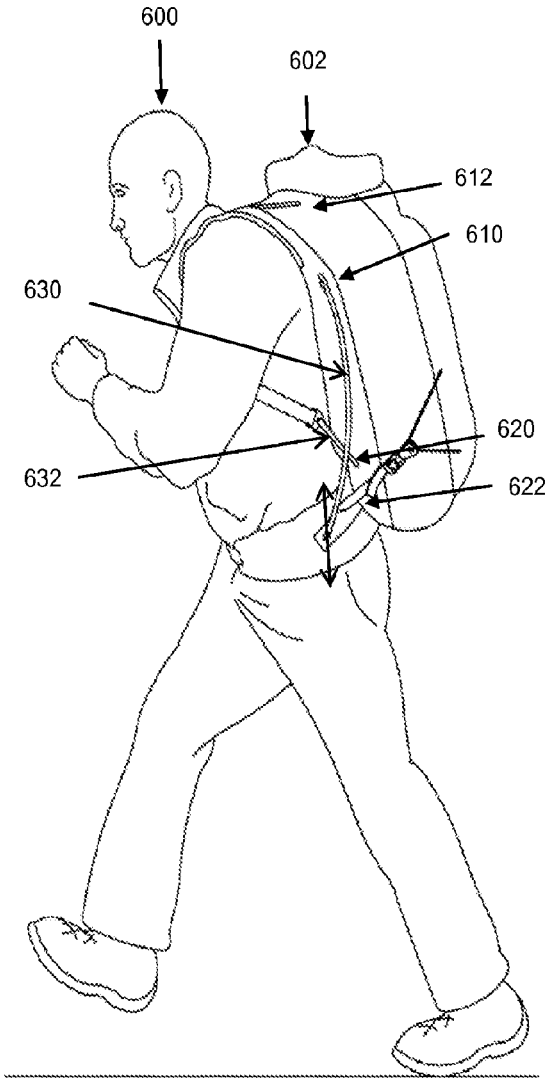
FIGS. 6A and 6B illustrate a person wearing an embodiment of a combined shoulder and hip harness while running at 9.6 km/h and carrying a load of 13.6 kg.
Figure 6B:
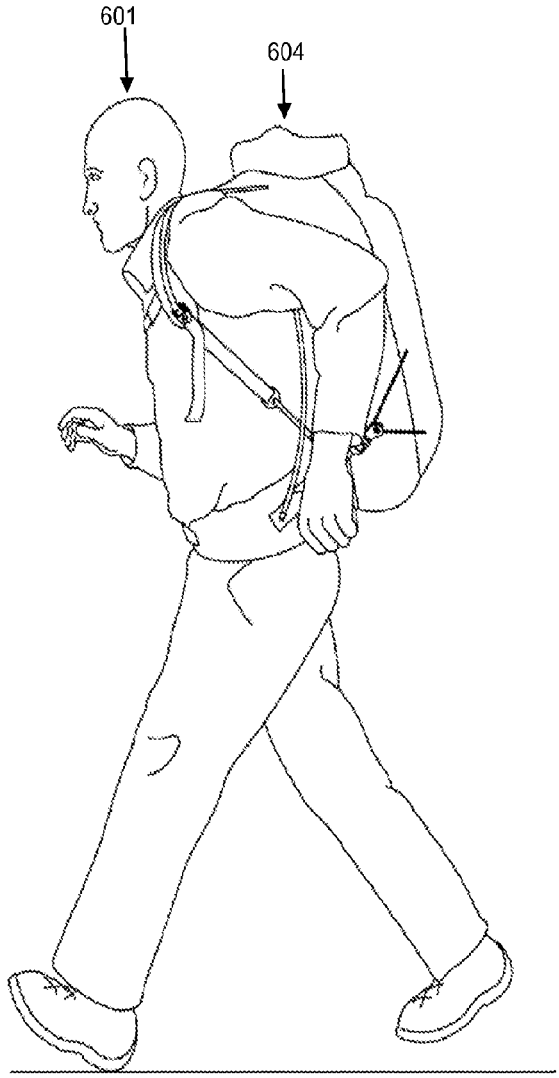

Referring to FIGS. 6A and 6B, the vertical support rods 630 are curved near the bottom and relatively straight near the top so that they extend inwardly and upward along the side of the container 602 in order to provide clearance for the wearer's arms. They also provide a space between themselves and the hip belt for the lower hip cord 632 to pass freely inside. The curvature of the rods should be gradual enough so that the vertical support rods will not hit the lower hip cord 632 as the rods move up and down 634 while a wearer walks or runs.

Referring back to FIG. 5, the tops of the vertical support rods are joined to a horizontal pivot shoulder bar 538. Said joint may be a ball and socket joint 542. A suitable length for the vertical support rods is 45 cm. The length of the vertical support rods can be in the range of 35 to 55 cm, depending upon the torso length of the wearer. Taller wearers would have longer vertical support rods.

The horizontal pivot shoulder bar proceeds through a horizontal pivot shoulder bar channel 544 behind the sheet frame. The shoulder bar is long enough so that its ends extend beyond the sides of the sheet frame when the bar is in the channel. A suitable dimension for the horizontal pivot shoulder bar is 2.5 cm wide by 30.5 cm long by 3.2 mm thick. The shoulder bar can also be wider at the center and tapir towards its ends. A suitable material for the shoulder bar is aluminum or other similarly strong and lightweight material. A suitable dimension for the channel is 7 to 12 cm wide by 25 cm long by 8 to 20 mm deep. The channel may also have a butterfly configuration where it is narrow in the center and expanded at the ends. Thus the bar is fee to move about the pivot point 546 and minimal pack volume is sacrificed for the channel. The back of the channel 545 may also extend to cover the end of the shoulder bar so that the end of the shoulder bar will not catch on the fabric of the container behind it as it moves up and down.

The horizontal pivot shoulder bar is pivotally joined 546 to the sheet frame at the midline of the sheet frame. This corresponds to about the center point of the wearer's shoulder blades. This is also about the same level as the attachment points of the shoulder straps (item 414, FIG. 4).

The net effect of the support rod configuration is that a substantial fraction of the load supported by the hip belt is transmitted 548 to the sheet frame at a high location. This location will be above the center of mass 552 of the load in the pack for most pack loadings. This will help stabilize the pack about the x axis as the wearer's hips oscillate about both the x and z axis as the wearer runs. Even if the pack is loaded so that the center of mass is above the pivot attachment point 546, the high position of the attachment point will minimize the tendency of the pack to oscillate.

The hip harness may additionally comprise a pair of lower stabilizing straps 572. Each strap is attached to a pivot point 522 on the spring hip bar and may be adjustable in length. One end of each strap is attached to a lower stabilizing strap pulley 568. A lower stabilizing strap chord 562 passes through each pulley. One end of each chord is attached near the back of the container at a mid level 564. The other end is attached at a level 566 vertically lower relative to mid level 564. The lower stabilizing strap cords may also be attached to adjustable length webbings which, in turn are attached to the container. Thus the effective length of the cords can be adjustable.

The stabilizing straps serve to help keep the load of the pack close to the runner with a force that is relatively independent of the bending of the runner at his/her waist. This can be important in rough terrain where a runner will have to constantly adjust his or her bend at the waist.

Combined Hip and Shoulder Harness

FIGS. 6A and 6B illustrate two strides of a runner 600, 601 wearing a pack 602, 604 with a combined shoulder harness and hip harness as described above. The pack was loaded with 13.6 kg of ballast with a center of mass below the runner's shoulder blades and below the horizontal pivot shoulder bar. The runner ran on a treadmill at a speed of 8 to 9.6 km/h. The running was filmed. The runner felt that the pack was relatively stable on his back with minimal bouncing or twisting. This perception was supported by subsequent review of the film where it was observed that the orientation of the pack stayed the same as the runner ran.

The same runner then wore a conventional pack with a fixed hip belt and shoulder harness. 13.6 kg of ballast was similarly added with the center of mass below the runner's shoulder blades. The runner ran at 8 km/h. The runner perceived that the bouncing and twisting of the pack was severe enough to throw him off balance. This perception was confirmed by review of the film.

The attachment points of the hip and shoulder harness to the frame and container of the pack should be selected to minimize twisting and bouncing of the back while the wearer is in motion. The attachment point 610 of the horizontal pivot shoulder bar channel to the frame, for example, should be below the attachment points 612 of the upper shoulder cord pulleys to the container. This will allow free alternating horizontal movement of the upper shoulder chord as well as free vertical pivoting motion of the horizontal pivot shoulder bar while maintaining relatively constant forces on the pack.

The attachment point 620 of the lower hip cord pulley spacer bar to the container should be behind the frame and above the attachment point of the horizontal spring hip bar to the frame. This will allow free horizontal movement of the lower shoulder cord between the lower shoulder cord pulleys as well as free vertical pivoting motion of the horizontal spring hip bar while also maintaining relatively constant forces on the pack. The relative distribution of these forces can be adjusted using the adjustable webbing and straps as described above.

Alternative Embodiments

Figure 7B:
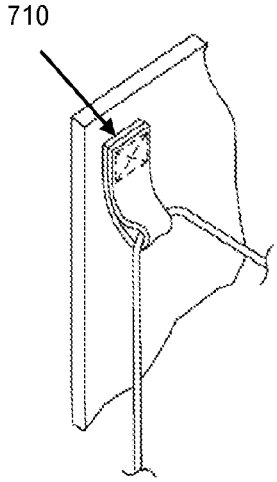
FIG. 7B illustrates an alternative means of slideable cord attachment.
Figure 7A:
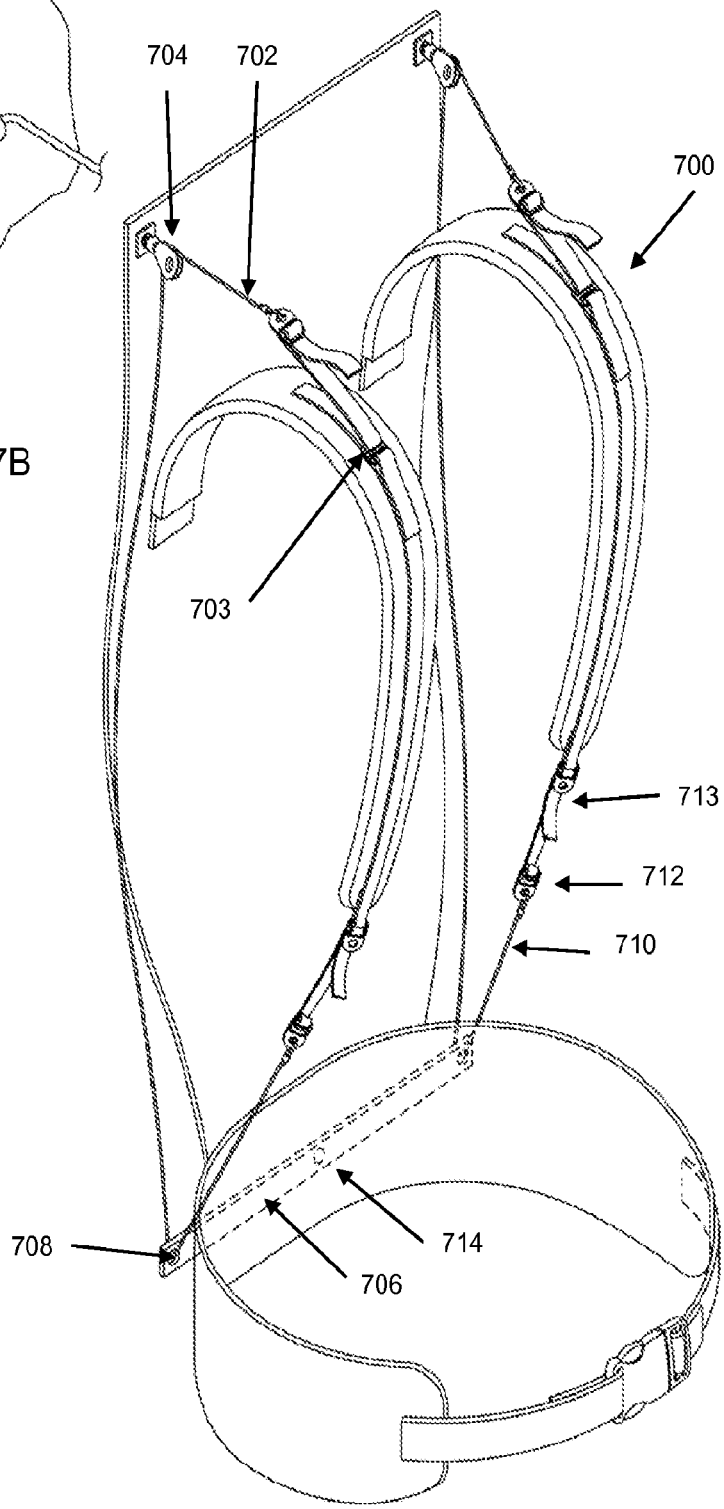
FIG. 7A illustrates an alternative embodiment of a shoulder harness.

FIG. 7A illustrates an alternative embodiment of a shoulder harness 700 where an upper shoulder cord 702 is attached to the top of each shoulder strap 703. The shoulder cords pass through an upper shoulder cord pulleys 704 and then proceed down to the ends of a horizontal hip pivot bar 706 where they are attached 708. A lower shoulder cord 710 attaches the bottom of each shoulder strap 712 to the horizontal hip pivot bar. The slower shoulder cord may comprise adjustable length webbing 713 or consist entirely of adjustable length webbing. Both shoulder straps have the same set up.

The horizontal hip pivot bar is attached to the sheet frame at pivot point 714.

FIG. 7B illustrates an alternative embodiment of a slideable cord attachment 710 that comprises a loop of low friction material such as Teflon®.

Alternative shoulder harnesses may be employed such that constant forces are applied to the pack from the shoulders even when the shoulders move with respect to each other.

Figure 8:
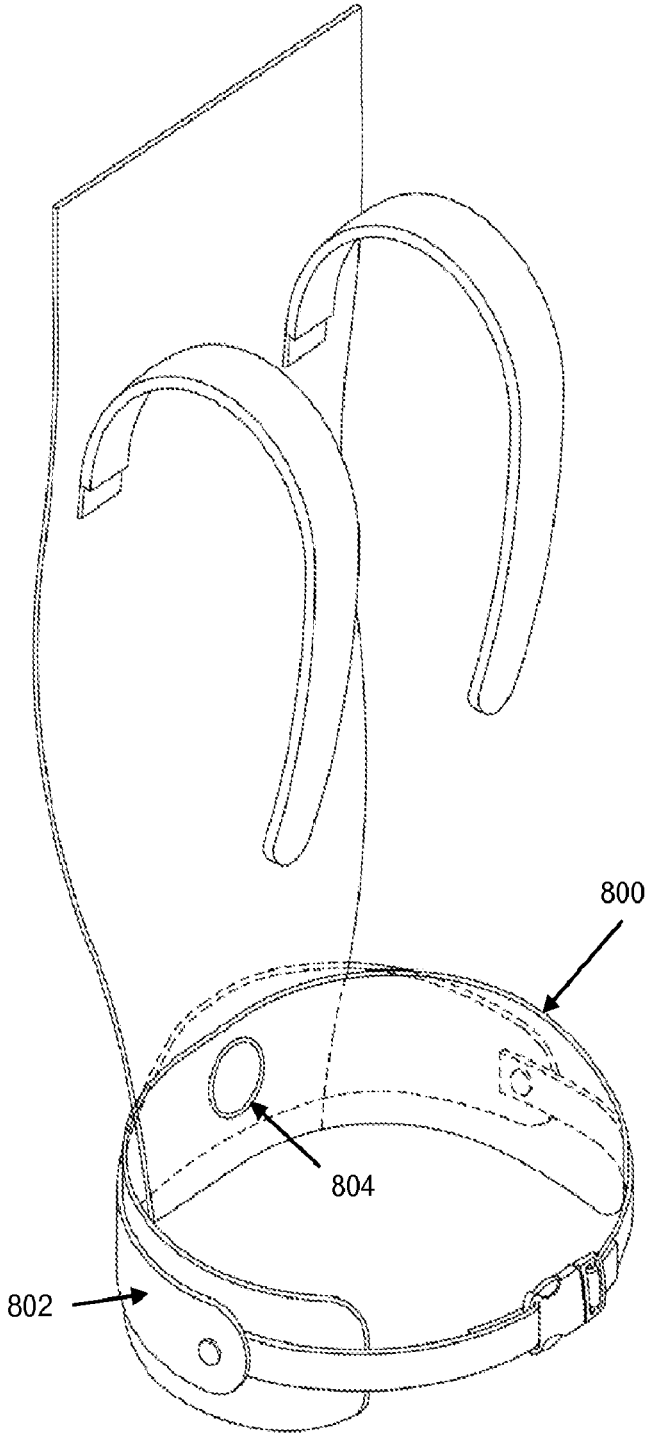
FIG. 8 illustrates an alternative embodiment of a hip harness.

FIG. 8 illustrates an alternative embodiment of a hip harness 800 that comprises a reinforced spring bar 802 and large pivot attachment 804 such that supporting rods are not required.

Figure 9:
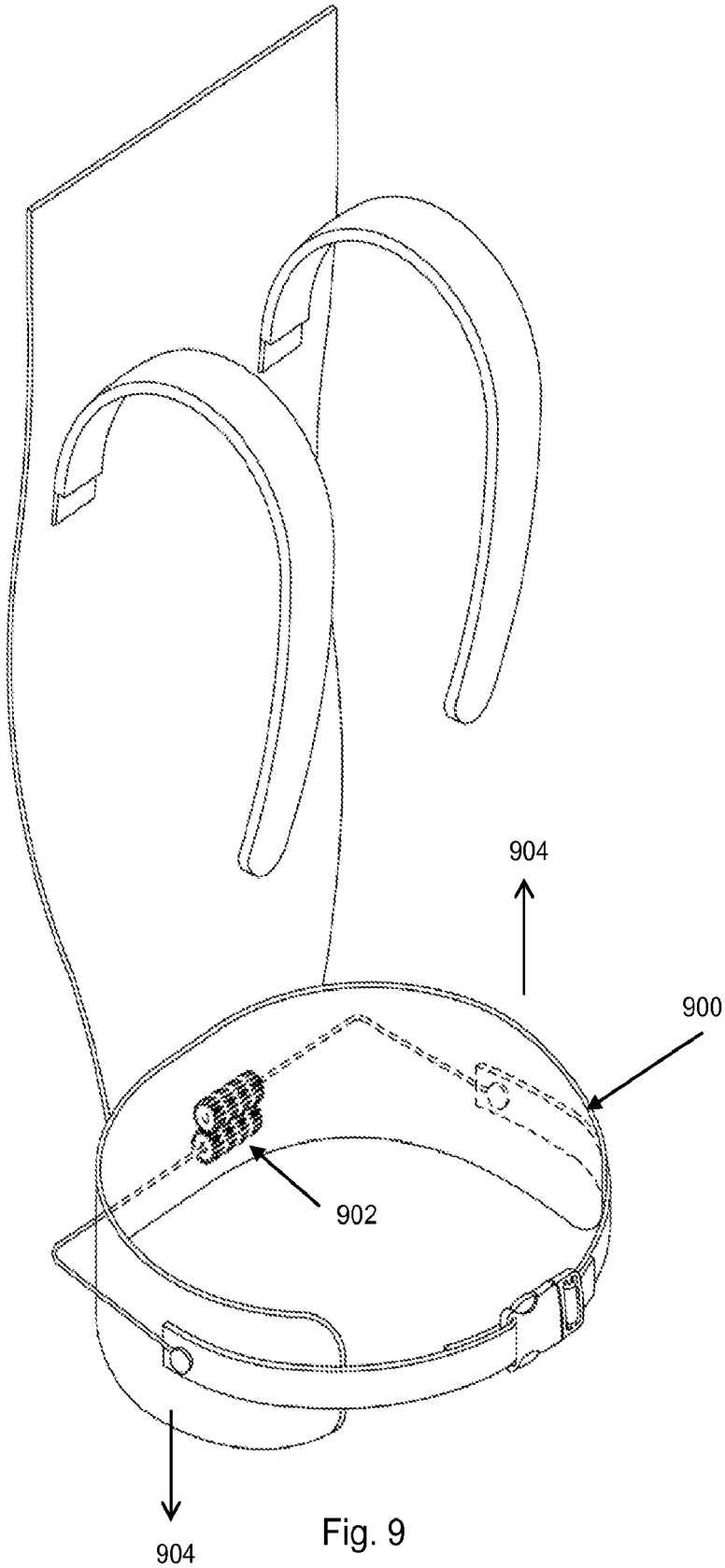
FIG. 9 illustrates an alternative embodiment of a hip harness.

FIG. 9 illustrates an alternative embodiment of a hip harness 900 which comprises gearing 902 which allows twisting movement 904 of the hip belt.

CONCLUSION

While particular embodiments of the present invention have been illustrated and described, it would be obvious to those skilled in the art that various other changes and modifications can be made without departing from the spirit and scope of the invention. Any of the aspects of the invention of the present invention found to offer advantages over the state of the art may be used separately or in any suitable combination to achieve some or all of the benefits of the invention disclosed herein.

Wherein I claim:

1. A backpack comprising:

a. a container;

b. a frame;

c. a hip belt, said hip belt comprising a buckle;

d. a horizontal spring hip bar;

e. a first vertical support rod;

f. a second vertical support rod;

g. a horizontal pivot shoulder bar; and h. a horizontal pivot shoulder bar channel;

wherein:

i. said container is mounted on said frame;

j. each end of said horizontal spring hip bar is pivotally attached to said hip belt;

k. the center of said horizontal spring hip bar is pivotally attached to said frame at about the centerline of said frame;

l. said horizontal pivot shoulder bar passes through said horizontal pivot shoulder bar channel;

m. said horizontal pivot shoulder bar is pivotally attached to about the center line of said frame such that the ends of said horizontal pivot shoulder bar may move in alternate vertical directions;

n. said horizontal pivot shoulder bar channel is horizontally attached to said frame;

o. the ends of said horizontal pivot shoulder bar extend beyond the sides of said frame;

p. the top of said first vertical support bar is pivotally attached to one end of said horizontal pivot shoulder bar;

q. the top of said second vertical support bar is pivotally attached to the other end of said horizontal pivot shoulder bar;

r. the bottom of said first vertical support bar is pivotally attached to one end of said horizontal spring hip bar; and s. the bottom of said second vertical support bar is pivotally attached to the other end of said horizontal spring bar.

2. The backpack of claim 1 which further comprises:

a. a first shoulder strap;

b. a second shoulder strap;

c. an upper shoulder cord; and d. first and second upper shoulder cord pulleys;

wherein:

e. said first shoulder strap is attached to one end of said upper shoulder cord;

f. said second shoulder strap is attached to the other end of said upper shoulder cord;

g. said first upper shoulder cord pulley is attached to said container at about the maximum height of said first shoulder strap and directly behind said maximum height of said first shoulder strap, said maximum height being the top said first shoulder strap when said shoulder strap is in a bowed configuration;

h. said second upper shoulder cord pulley is attached to said container at about the maximum height of said second shoulder strap and directly behind said maximum height of said second shoulder strap;

i. said upper shoulder strap cord passes through said first and second upper shoulder cord pulleys and is free to move such that relatively constant horizontal forces are provided to said pack by said upper shoulder cord pulleys if the positions of said first and second shoulder straps are varied; and j. the top ends of said shoulder straps are attached to said container at a position below said first and second upper shoulder cord pulleys.

3. The backpack of claim 2 which further comprises:

a. a lower hip cord;

b. first and second lower hip cord pulleys; and c. a lower hip cord pulley spacer bar;

wherein:

d. the bottom of said first shoulder strap is attached to one end of said lower hip cord;

e. the bottom end of said second shoulder strap is attached to the other end of said lower hip cord;

f. said first and second lower hip cord pulleys are attached to opposite ends of said lower hip cord pulley spacer bar; and g. said lower hip cord spacer bar is positioned behind said frame and attached to said container at about the height of said hip belt such that said lower hip cord may move freely between said lower hip cord pulleys.

4. The backpack of claim 3 wherein said vertical support rods are curved near the bottom and relatively straight near the top so that they proceed inwardly and upwardly along the side of the container.

5. The backpack of claim 4 wherein said curvature is gradual enough so that said lower hip cord can pass between said vertical support rods and said container without said vertical support rods hitting said lower hip cord as said rods move up and down.

6. The backpack of claim 3 wherein said attachment point of said lower hip cord spacer bar to said container is above said attachment point of said spring hip bar to said frame.

7. The backpack of claim 3 wherein one or more of said pulleys is mounted on flexible webbing.

8. The backpack of claim 3 wherein one or more of said cords is attached to adjustable webbing.

9. The backpack of claim 2 wherein said attachment points of said first and second upper shoulder cord pulleys to said container is above said attachment point of said horizontal pivot shoulder bar channel to said frame.

10. The backpack of claim 1 wherein one or more of said pivotal attachments is by means of a ball and socket joint.

11. The backpack of claim 1 which further comprises:

a. first and second lower stabilizing straps;

b. first and second lower stabilizing strap pulleys; and c. first and second lower stabilizing strap cords;

wherein:

d. one end of each of said lower stabilizing straps is attached to said hip belt;

e. the other end of each of said lower stabilizing straps is attached to one of said lower stabilizing strap pulleys;

f. each one of said lower stabilizing strap cords passes through one of said lower stabilizing strap pulleys;

g. one end of each of said lower stabilizing strap cords is attached to the back of said container at a mid-level; and h. the other end of each of said lower stabilizing strap cords is attached to the back of said container at a low level.

* * * * *